US010357423B2

(12) United States Patent
Davis

(10) Patent No.: US 10,357,423 B2
(45) Date of Patent: Jul. 23, 2019

(54) DEVICE FOR THE THERAPEUTIC TREATMENT OF FOOT AND/OR HEEL PAIN

(76) Inventor: Eddie Davis, Houston, TX (US)

( * ) Notice: Subject to any disclaimer, the term of this patent is extended or adjusted under 35 U.S.C. 154(b) by 703 days.

(21) Appl. No.: 12/964,713

(22) Filed: Dec. 9, 2010

(65) Prior Publication Data

US 2012/0150082 A1 Jun. 14, 2012

(51) Int. Cl.
*A61H 1/02* (2006.01)
*A61H 15/00* (2006.01)

(52) U.S. Cl.
CPC ..... *A61H 15/0092* (2013.01); *A61H 1/0237* (2013.01); *A61H 1/0266* (2013.01); *A61H 2015/0014* (2013.01); *A61H 2201/1253* (2013.01); *A61H 2201/164* (2013.01); *A61H 2205/12* (2013.01)

(58) Field of Classification Search
CPC ..... A61H 15/0092; A61H 2015/0014; A61H 2015/0021; A61H 2015/0028; A61H 2015/0035; A61H 2015/005; A61H 1/024; A61H 1/0266; A61H 2001/027; A61H 1/0237
USPC ..... 601/112, 117–125, 128–132, 134–135; 482/79–80, 91, 121–122, 124, 126, 132
See application file for complete search history.

(56) References Cited

U.S. PATENT DOCUMENTS

| | | | | | |
|---|---|---|---|---|---|
| 1,560,549 | A * | 11/1925 | Duncan | 601/120 | |
| 2,467,943 | A * | 4/1949 | Mikell, Jr. | 482/79 | |
| 3,747,593 | A * | 7/1973 | Taylor | 601/40 | |
| 4,023,808 | A * | 5/1977 | Hebert | 482/126 | |
| 4,026,549 | A * | 5/1977 | Gunn | 482/124 | |
| 4,720,098 | A * | 1/1988 | Gordon | 482/108 | |
| 4,852,874 | A * | 8/1989 | Sleichter et al. | 482/122 | |
| 4,930,767 | A * | 6/1990 | Hamm | 482/80 | |
| 5,039,093 | A * | 8/1991 | Collier | 482/124 | |
| 5,518,481 | A * | 5/1996 | Darkwah | 482/126 | |
| 5,556,368 | A * | 9/1996 | Akin | A63B 21/002 | 482/121 |
| 5,569,136 | A * | 10/1996 | Holten | 482/126 | |
| 5,643,182 | A * | 7/1997 | Engel | 601/119 | |
| 6,036,626 | A * | 3/2000 | Taylor | 482/121 | |
| 6,203,476 | B1 * | 3/2001 | Wang | A63B 21/0552 | 482/121 |
| 6,672,997 | B1 * | 1/2004 | Winkler | 482/126 | |
| 7,387,599 | B1 * | 6/2008 | Hsu | A61H 15/0092 | 482/122 |
| 2008/0200851 | A1 * | 8/2008 | Faussett | A61H 15/0092 | 601/119 |

* cited by examiner

*Primary Examiner* — Valerie L Woodward
(74) *Attorney, Agent, or Firm* — Delphine James

(57) ABSTRACT

A device for relieving foot or heel pain having of a top and bottom horizontal cylindrical members attached by flexible, adjustable cords. The first cylindrical member is placed under the affected foot while second cylindrical member is placed over the knee and held in place to provide resistance. The bottom cylindrical member is used to provide a gentle massage to the affected foot while the foot is held in the flex position.

11 Claims, 4 Drawing Sheets

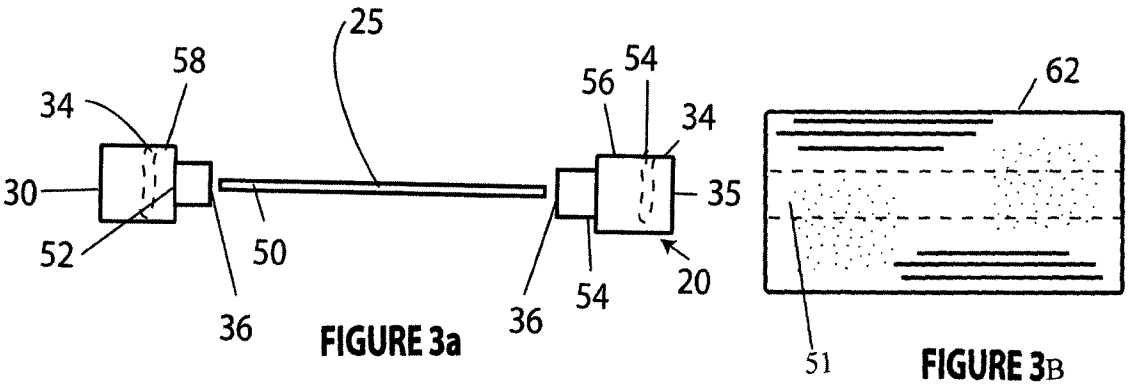
FIGURE 3B
FIGURE 3a
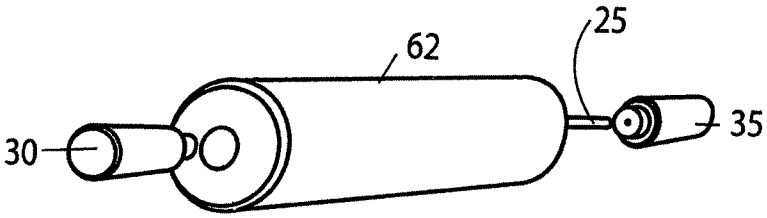
FIGURE 4

DEVICE FOR THE THERAPEUTIC TREATMENT OF FOOT AND/OR HEEL PAIN

CROSS REFERENCE TO RELATED APPLICATIONS

This application claims the benefit of the filing date of U.S. Provisional Patent Application No. 61/267,930 filed Dec. 9, 2009, the disclosure of which is hereby incorporated herein by reference.

BACKGROUND OF INVENTION

The present invention relates generally to a device for use in relieving pain in the foot or heel on the body. In particular, the present invention relates to a device which provides a gentle massage to the areas of the body in order to alleviate pain resulting from and speed the healing of plantar fasciitis and/or bone spurs.

A bone spur or osteophyte is a bony growth formed on normal bone which is smooth. It can cause pain or wear and tear if it presses or rubs against other bones of soft tissues. Common places for bone spur are the spine, shoulders, knees, hips and feet. As the body tries to repair itself, it will build extra bone causing a bone spur. Bone spurs usually don't require treatment unless they cause pain, since most people are unaware that they have bone spurs. Treatment includes weight loss, stretching exercises, ice, and non-steroidal anti-inflammatory drugs (NSAIDs) such as ibuprofen. If the bone spur is located in the foot, a heel pad or orthopedic insert can be used. Surgery is also another option.

Plantar Fasciitis is inflammation of the thick, fibrous band of tissue, plantar fascia, which reaches from the heel to the toes and supports the muscles and arch of the foot. It occurs when the plantar fascia becomes overstretched. Plantar Fasciitis can also be treated with stretching exercises, ice, and nonsteroidal anti-inflammatory drugs (NSAIDs). Also, regulation of weight helps to prevent it. Other treatments include a heel pad, night splint, ultrasound physical therapy, steroid injections, walking cast, or shock wave therapy. A night splint prevents the plantar fascia from shortening during sleep by holding the foot at a specific angle. A walking cast is used when plantar fasciitis is unresponsive to typical treatment and holds the foot in a position to allow the plantar fascia to stretch and heal. Shock wave therapy is a new procedure which may be prescribed before considering surgery. Surgery can be prescribed if the pain becomes debilitating. The most common surgery is called plantar fascia release which releases a portion of the plantar fascia from the heel bone. About 1 in 20 patients will actually need surgery.

SUMMARY OF INVENTION

The object of the invention is to provide therapeutic massage to the foot in order to relive pain caused by plantar fasciitis or bone spurs. Plantar fasciitis affects the plantar fascia which is the fibrous band of connective tissue that supports the longitudinal arch of the foot. In other words, it runs from the heel bone to the ball of the foot. This ligament can become inflamed due to repetitive strain which develops into plantar fasciitis. Bone spurs occur when the body tries to repair itself and will create extra bone causing a bony growth. When the parts of the body like muscles or ligaments become unduly stressed or strained, the body will create a bone spur as it tries to repair the damage.

The present invention utilizes a top and bottom horizontal cylindrical members attached a predetermined distance apart by flexible cords. The bottom cylindrical member is used to provide a gentle massage to the affected foot. The foot has two flex positions: plantar flexion and dorsiflexion. In the plantar flexion position, the foot is flexed downward creating a point in the toes. In the dorsiflexion position, the foot is flexed upward and this position utilized in the preferred embodiment of the present invention. The first cylindrical member is placed under the affected foot while second cylindrical member is placed over the knee and held in place to provide resistance.

Securely attached parallel tension cords are adjusted to place the toes in a dorsiflexed position in order to provide the desire stretch to the plantar fascia.

BRIEF DESCRIPTION OF DRAWINGS

FIG. 3*a* illustrates an exploded view of the mid-section of the bottom bar member.

FIG. 3*b* illustrates an exploded view of the bottom bar member without the mid-section.

FIG. 4 illustrates an exploded vide of the bottom bar member

DETAILED SPECIFICATIONS

Figure 1:
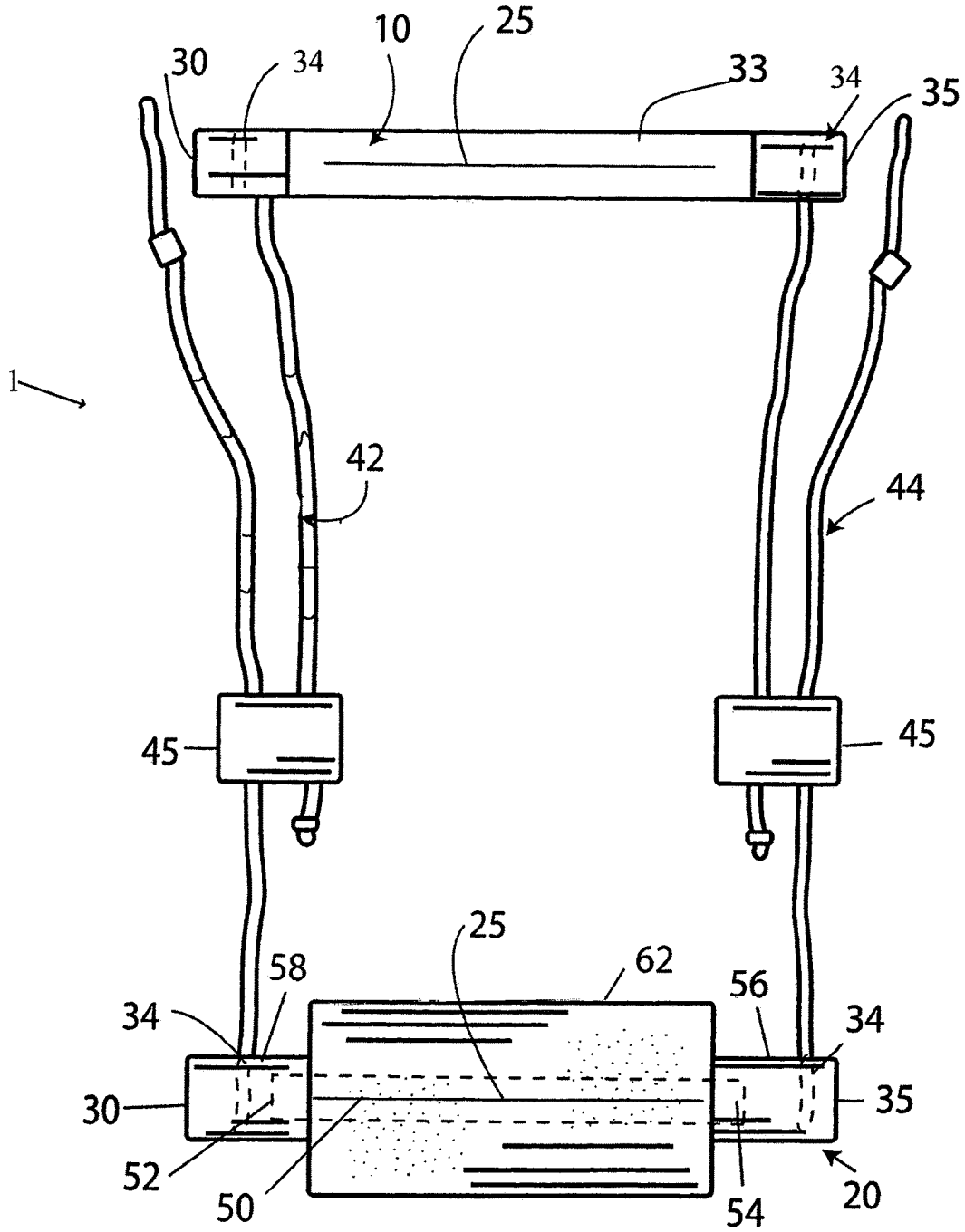
FIG. 1 illustrates a perspective view of the device.
Figure 2:
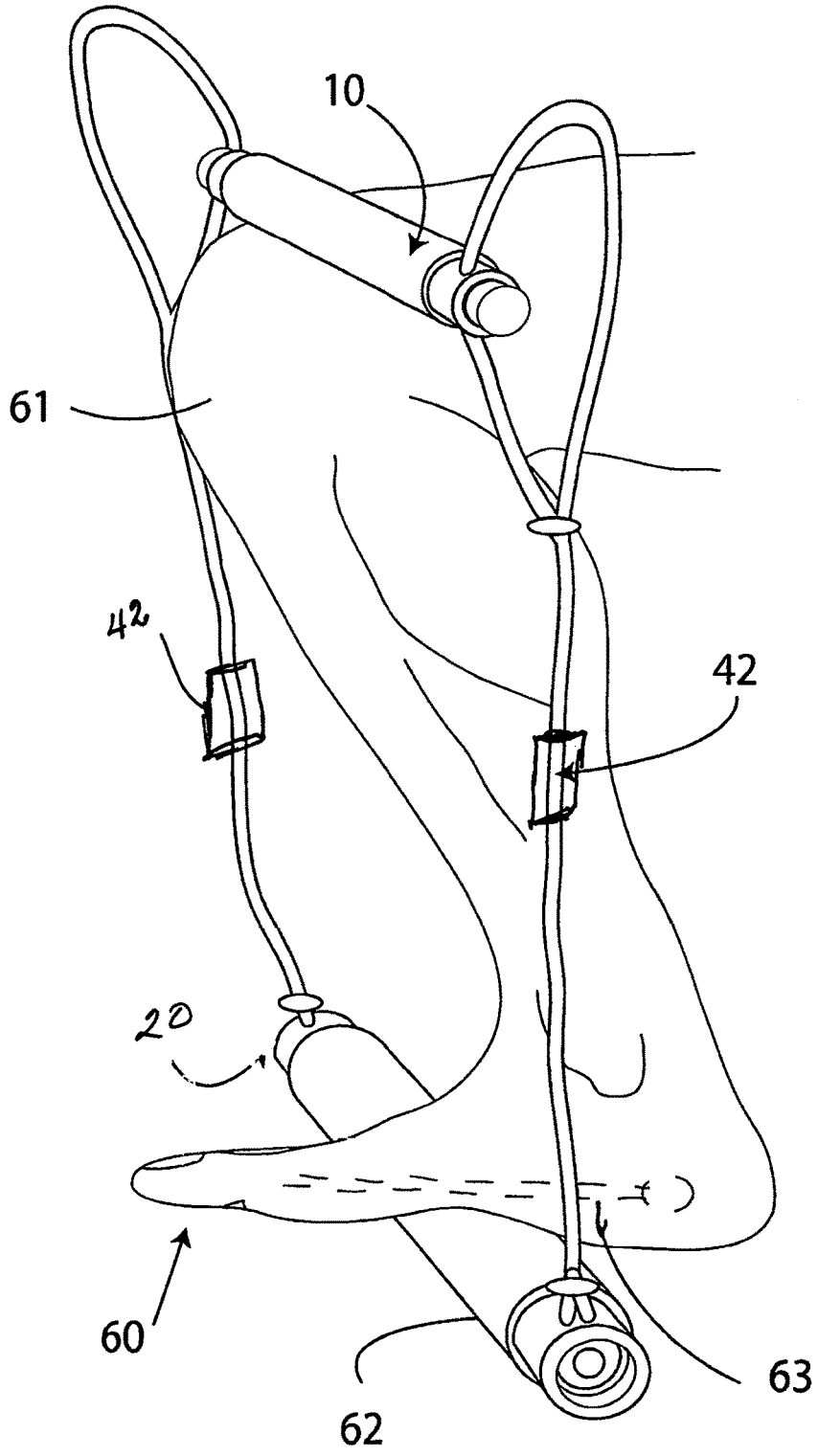
FIG. 2 illustrates a perspective view of the device while in use.

Referring to FIGS. 1 and 2, there is shown a therapeutic device (1). The therapeutic device (1) comprises a top bar member (10) and bottom bar member (20) having equivalent dimensions with a longitudinal axis designated as (25) of a predetermined length. In the preferred embodiment each bar member (10, 20) further comprises a first outer face plane (30) and an opposing second outer face plane (35) aligned perpendicular to the longitudinal axis (25) of each bar member (10, 20). An outer surface area (33) forming the body of top bar member encircles the longitudinal axis (25) and is sandwiched between the two outer face planes (30, 35).

In the preferred embodiment as shown the top bar member (10) and the bottom bar member (20) are cylindrical in shape. Additionally, as shown, the outer face planes (30, 35) are circular in shape. However, the scope of this invention includes a bar having potentially an octagonal shape as long as mid section 62 is adapted to rotate upon bottom bar member (20). Additionally, the top bar member (10) does not have to be cylindrical, the top bar member (10) can be flat to provide the most support for the knees.

As depicted in FIG. 1, the top bar member (10) is arranged horizontally parallel to the bottom bar member (20) disposed a predetermined distance apart from each other. Connecting the top bar member (10) to the bottom bar member (20) is a pair of vertically parallel aligned flexible cord members (42, 44) disposed a set distance apart from each other. The first cord member (42) extends linearly downward between top bar member (10) and bottom bar member (20) and is securely attached near the end of the first outer face plane (30) of the top bar member (10) and bottom bar member (20). The second cord member (42) extends linearly downward linearly downward and is securely attached near the end of the opposing second outer face plane of the top bar member (10) and the bottom bar member (20).

Substantially centrally disposed within each flexible cord member (42, 44) is a connector member (45) which is adapted to respectfully adjust the length of each flexible cord member (42, 44) independently. In the preferred embodiment disposed near end of each outer facing member (30, 35) within the top bar member (10) and the bottom bar member (20) is a vertical bore (34) having a diameter to securely receive an end of the flexible cord member (42, 44). The cord member (42, 44) can be securely connected within the bore (34) via a fastener or knot tying and secures the cord member (42, 44) in place.

Referring to FIGS. 3 and 3*a*. the bottom bar member (20) is further defined by a disjoined sections including first outer section (58), an opposing second outer section (56) with a mid-section (62) situated there between. A bore (51) is centrally disposed through the entire length of the bottom bar member (20). A rod member (50) is disposed within the bore (51) thereby causing the mid section (62) of the bottom bar member (20) to rotate thereupon. The inner face (52, 54) of each outer section (58, 56) has a recessed area (36) protruding linearly outward for securely receiving the opposed outer ends of the rod member (50) therein. Within each recessed area (36) is a bore adapted to receive the opposing outer ends of rod member (50).

Figure 5:
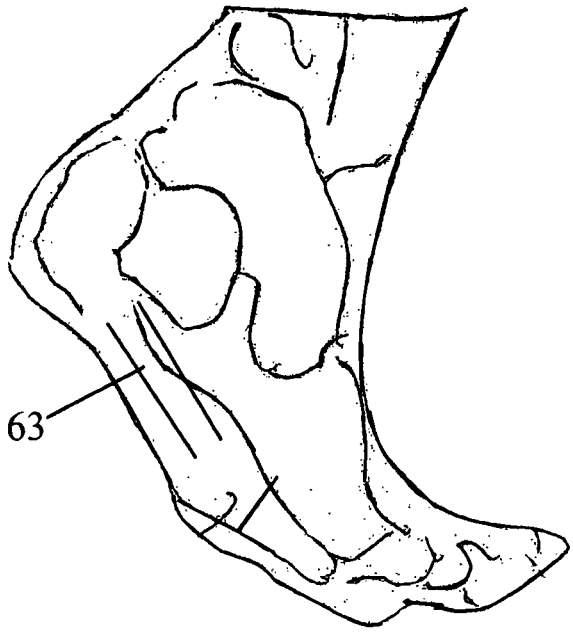
FIG. 5 illustrates the anatomy of the foot.

In use, as shown in FIG. 2, the arch of the affected foot (60) is placed over the midsection (62) of the bottom bar member (20) with the affected foot (60) in a doriflexed position. Next, utilizing the connector member (45) of each flexible cord member (42, 44) the length is adjusted to provide the most tension of the wearer of the therapeutic device. Next, the covering of the top bar member (10) is placed over the knee (61). Then the affected foot (60) is repetitively rolled over the mid section (62) of the bottom bar member (20) causing the inflammation within the plantar fascia (63) as shown in FIGS. 2 and 5 to be disseminated. The repetition of this process causes relief of the inflammation over time. FIG. 5 is provided to show the anatomy of the foot in relation to the plantar fascia (63) ligament.

What is claimed is:

1. A therapeutic device for massaging an arch of a user's foot affected with inflammation, the user's foot connected to a lower leg while bent at the knee, the device comprising:

a top unitary horizontal member having a first end and an opposing second end;

a bottom segmented horizontal member with a first end section, an opposing second end section and a disjoined mid-section therebetween;

the top horizontal member spaced apart a pre-determined distance opposite from the bottom horizontal member in horizontal parallel arrangement, wherein an opened support area is formed therebetween for receiving the connected knee therein; the top and bottom horizontal members being long enough to accommodate the width of a user's knee but not long enough to accommodate both knees simultaneously; the top horizontal member having a mid-section that is stationary and having an underside configured to receive the connected knee; the disjoined mid-section rotationally mounted between the first end section and the opposing second end section of the bottom horizontal member; the disjoined mid-section having a continuous smooth outer surface area;

a flexible and stretchable first cord member connecting the first end of the top horizontal member to the first end section of the bottom horizontal member;

a flexible and stretchable second cord member connecting the second end of the top horizontal member to the second end section of the bottom horizontal member;

the first cord member and the second cord member having a predetermined length wherein the opened support area is formed to generate a desired tension therebetween relative to the user's lower leg length; wherein the therapeutic device is configured to secure the user's lower leg immovably within the opened support area as the underside of the foot is rotated, the predetermined length being substantially less than the user's lower leg length to secure an underside of the top horizontal member upon the bent connected knee rendering the user's lower leg immovable within the opened support area thereby, allowing the arch of the user's foot to freely rotate upon the mid-section unsecured therewith.

2. The therapeutic device of claim 1 wherein the top horizontal member further comprises an outer surface area being surrounded by a soft flexible member.

3. The therapeutic device of claim 2 wherein the soft flexible member is removable.

4. The therapeutic device of claim 1 wherein a first independently adjustable member is operationally connected to the first cord member disposed between the first end and the first end section.

5. The therapeutic device of claim 4 wherein the first independently adjustable member is a bungee cord.

6. The therapeutic device of claim 1 wherein a second independently adjustable member is operationally connected to the second cord member disposed between the second end and the opposing second end section.

7. The therapeutic device of claim 6 wherein the second independently adjustable member is a bungee cord.

8. A method of massaging an arch of a user's foot affected with inflammation, the user's foot connected to a lower leg while bent at the knee, the method comprising:

providing the device in claim 7;

placing the arch of the user's foot upon the midsection of the bottom horizontal member;

placing the user's lower leg within the opened support area with the top horizontal member seated atop the knee with the opened support area below the top horizontal member; wherein the leg is immovable within the opened support area while only the user's foot is rolled back and forth;

setting the first flexible cord member to a desired length for a desired tension to secure the knee within the opened support area;

setting the second flexible cord member to a desired length for a desired tension to secure the knee within the opened support area;

and rolling the arch of the user's foot backward and forward upon the mid-section for an effective amount of time;

wherein the desired tension level is achieved by operationally manipulating a first adjustable member to a desired tension level and operationally manipulating the second adjustable member to the desired tension level, wherein the top horizontal member is pulled toward the bottom horizontal member thereby creating the desired tension level upon the user's lower leg within the opened support area.

9. The therapeutic device of claim 1 wherein the bottom horizontal member further comprises:

a horizontal cavity extending substantially through a center of the disjoined mid section along a longitudinal axis extending there through;

and a continuous rod member extending through the horizontal cavity and being fixably attached to the first end section and the second end section wherein the disjoined mid-section is rotationally mounted upon the bottom horizontal member.

10. A method of massaging an arch of a user's foot affected with inflammation, the user's foot connected to a lower leg while bent at the knee, the method comprising:

providing the device in claim 1;

placing the arch of the user's foot upon the midsection of the bottom horizontal member;

placing the user's lower leg within the opened support area with the top horizontal member seated atop the knee with the user's leg being disposed in the opened support area below the top horizontal member; wherein the leg is immovable within the opened support area while only the user's foot is rolled back and forth;

setting the first flexible cord member to a desired length for a desired tension to secure the knee within the opened support area;

setting the second flexible cord member to a desired length for a desired tension to secure the knee within the opened area;

and rolling the arch of the user's foot backward and forward upon the mid-section for an effective amount of time.

11. The method of claim 10 further comprising:

operationally manipulating a first adjustable member and operationally manipulating a second adjustable member wherein the top horizontal member is pulled toward the bottom horizontal member thereby creating the desired tension level upon the user's lower leg within the opened support area.

* * * * *